US011262032B1

(12) United States Patent
Laxton

(10) Patent No.: US 11,262,032 B1
(45) Date of Patent: Mar. 1, 2022

(54) FLASHLIGHT

(71) Applicant: Alejandro Laxton, Elkhart, IN (US)

(72) Inventor: Alejandro Laxton, Elkhart, IN (US)

( * ) Notice: Subject to any disclaimer, the term of this patent is extended or adjusted under 35 U.S.C. 154(b) by 0 days.

(21) Appl. No.: 17/444,934

(22) Filed: Aug. 12, 2021

Related U.S. Application Data

(60) Provisional application No. 63/065,921, filed on Aug. 14, 2020.

(51) Int. Cl.
*F21L 4/04* (2006.01)
*F21V 23/06* (2006.01)

(52) U.S. Cl.
CPC ..... *F21L 4/045* (2013.01); *F21V 23/06* (2013.01)

(58) Field of Classification Search
CPC ..... F21L 4/045; F21V 23/06
See application file for complete search history.

*Primary Examiner* — Mary Ellen Bowman
(74) *Attorney, Agent, or Firm* — Botkin & Hall, LLP

(57) ABSTRACT

A flashlight having a directable beam of light from an upper section affixed to a base. The base has a bottom end and a sidewall extending upwardly from the base. A connector is made from a resilient material that has a first end and a second end. The connector has at least one score that is located between the first end and second end. The connector is bendable about the score so that the connector is movable between an extended and retracted position. An upper section is affixed to the connector and the upper section is located nearer the base when the connector is in its retracted position and relatively far from the base when the connector is in its extended position.

4 Claims, 7 Drawing Sheets

FLASHLIGHT

CROSS REFERENCE TO RELATED APPLICATIONS

This application claims the benefit of U.S. Provisional Application No. 63/065,921, filed Aug. 14, 2021, the disclosures of which are hereby incorporation by reference.

BACKGROUND OF THE INVENTION

Flashlights traditionally have been large straight bulky items that allow little flexibility to redirect the light they produce as well as hold themselves into a position that is more user friendly. It is important for some applications that the flashlight be compact yet be capable of being reconfigured to a larger size or a size that will assist the user of the flashlight. Additionally, a flashlight that can cast its light in a desired direction without the user's hands is beneficial.

SUMMARY OF THE INVENTION

A flashlight having a base. The base having a bottom end and a sidewall extending upwardly from the base. A connector is made from a resilient material that has a first end and a second end. The connector has at least one score that is located between the first end and second end. The connector is bendable about the score so that the connector is movable between an extended and retracted position. An upper section is affixed to the connector and is located nearer the base when the connector is in its retracted position and relatively far from the base when the connector is in its extended position.

DETAILED DESCRIPTION OF INVENTION

Figure 6:
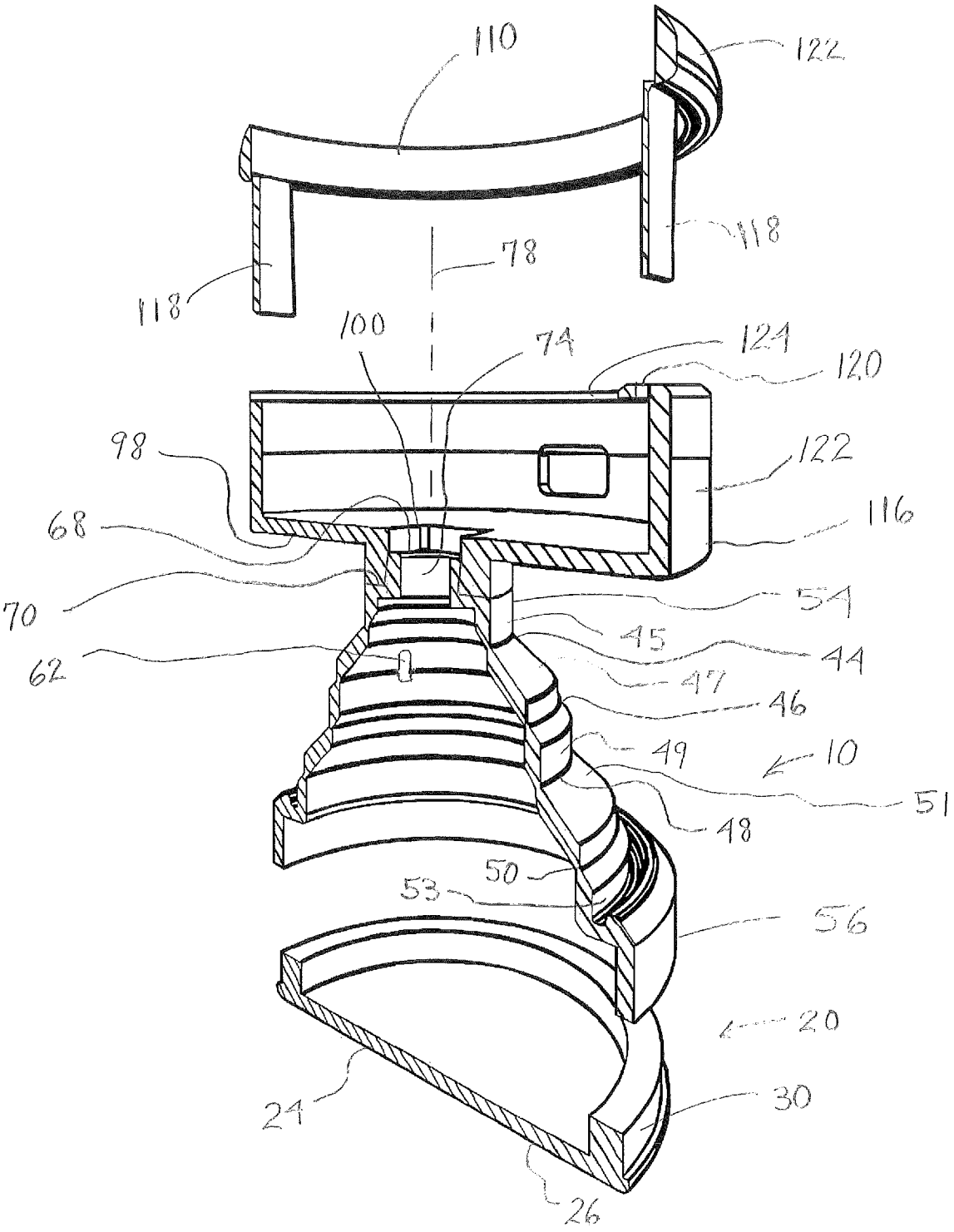
FIG. 6 is an exploded view of the flashlight.
Figure 7:
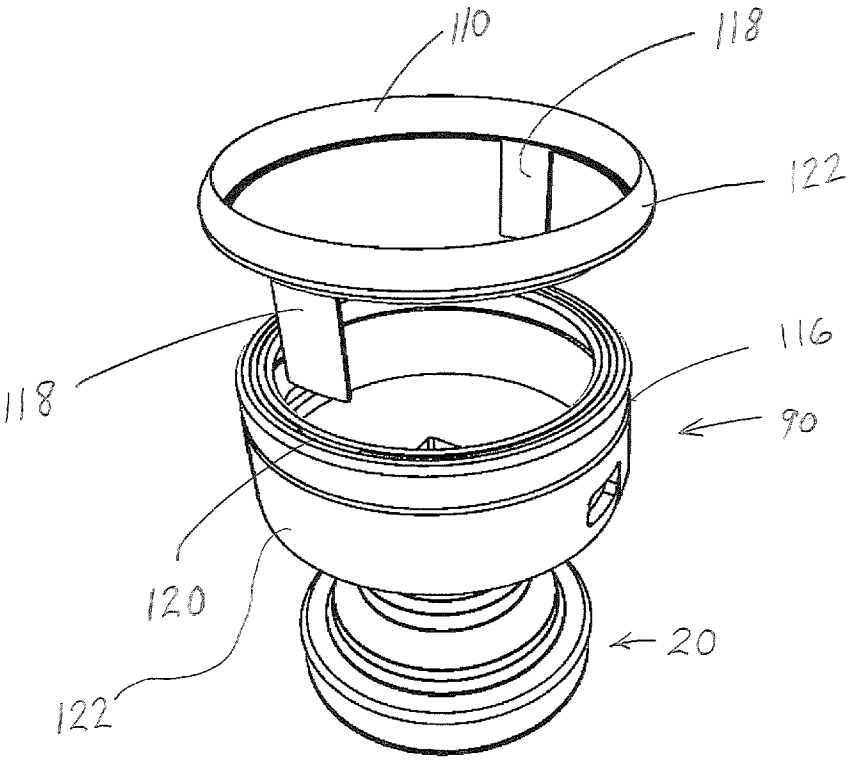
FIG. 7 is another exploded view of the flashlight shown in FIG. 6.

FIG. 6 shows the flashlight 10 of the present invention in an exploded view. A base 20 has bottom piece 24 that includes a bottom end 26 that has a sidewall 30 that extends upwardly from the bottom end 26 of the bottom piece 24. The sidewall 30, in the present case, is joined to a connector 40. However, it is contemplated that the base 20 could be a square or rectangular shape and still serve the intended function.

A connector 40 is made from an elastomeric material and has a series of scores 44, 46, 48, 50 that are thinned areas around the connector 40. In addition to being generally described as scores 44, 46, 48, 50 each are correspondingly described as: first score 44, second score 46, third score 48, and fourth score 50. The scores separate wall portions 45, 47, 49, 51, and 53 that are located adjacent to, and in some cases between the scores 44, 46, 48, 50. In addition to being generally described as wall portions 45, 47, 49, 51, and 53 each are correspondingly described as: first wall portion 45, second wall portion 47, third wall portion 49, fourth wall portion 51, and fifth wall portion 53. The elastomeric material of the connector 40 is resilient and generally flexible, and the scores 44, 46, 48, 50 are annularly around the generally conically shaped connector 40 to provide areas of predictable bending. The wall portions 45, 47, 49, 51, 53 are also annular abound the connector 40. The connector 40 has a first end 54 and a second end 56 that is opposite the first end 54. As shown in FIG. 6, the four scores 44, 46, 48, 50 around the connector 40 are between the first end 54 and second end 56.

Figure 2:
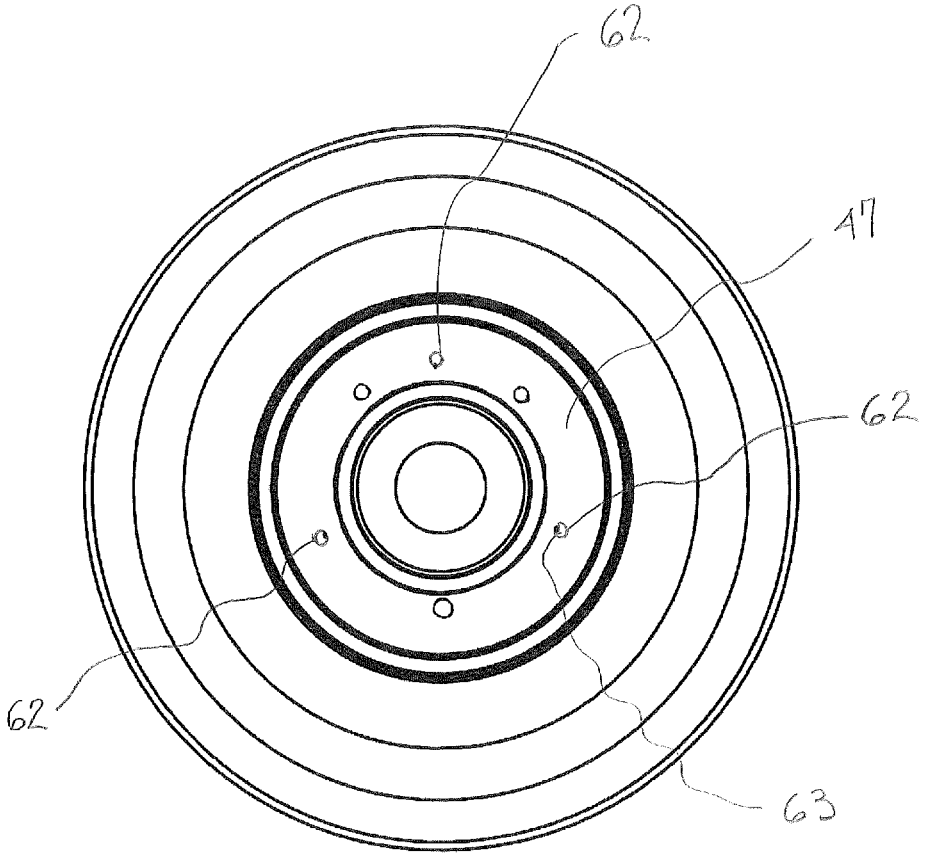
FIG. 2 is a view of the connector of the flashlight in FIG. 1 looking from the base toward the upper section fully extended.
Figure 3:
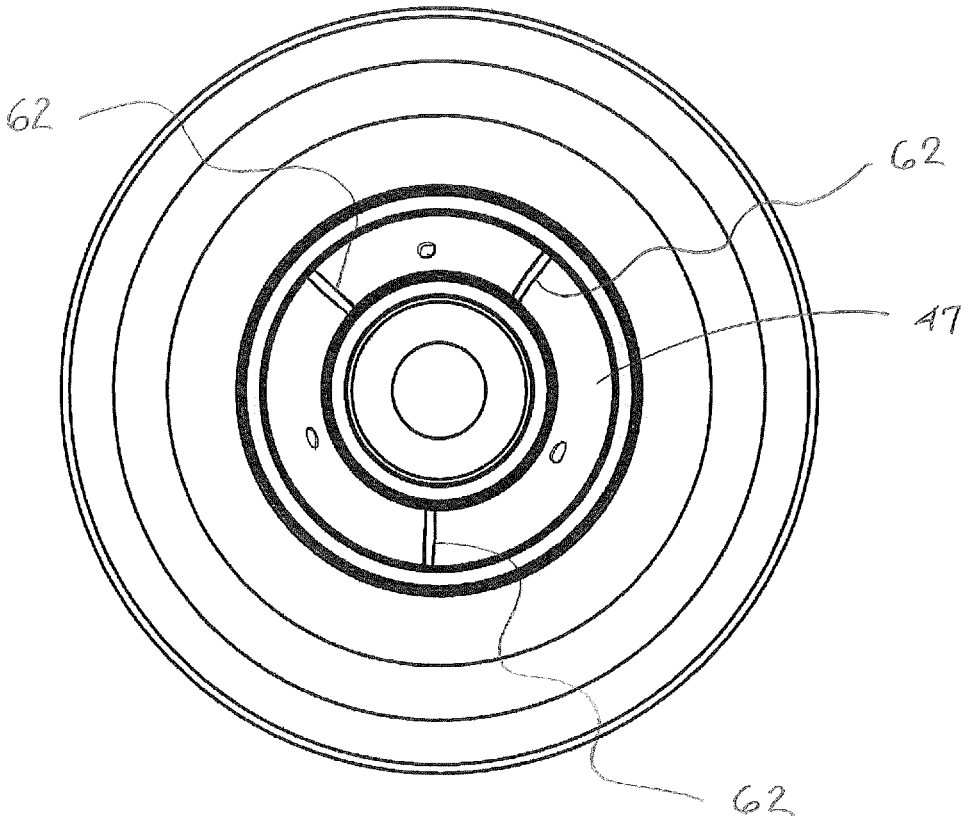
FIG. 3 is a is a view of the connector of the flashlight in FIG. 2 fully compressed.
Figure 4:
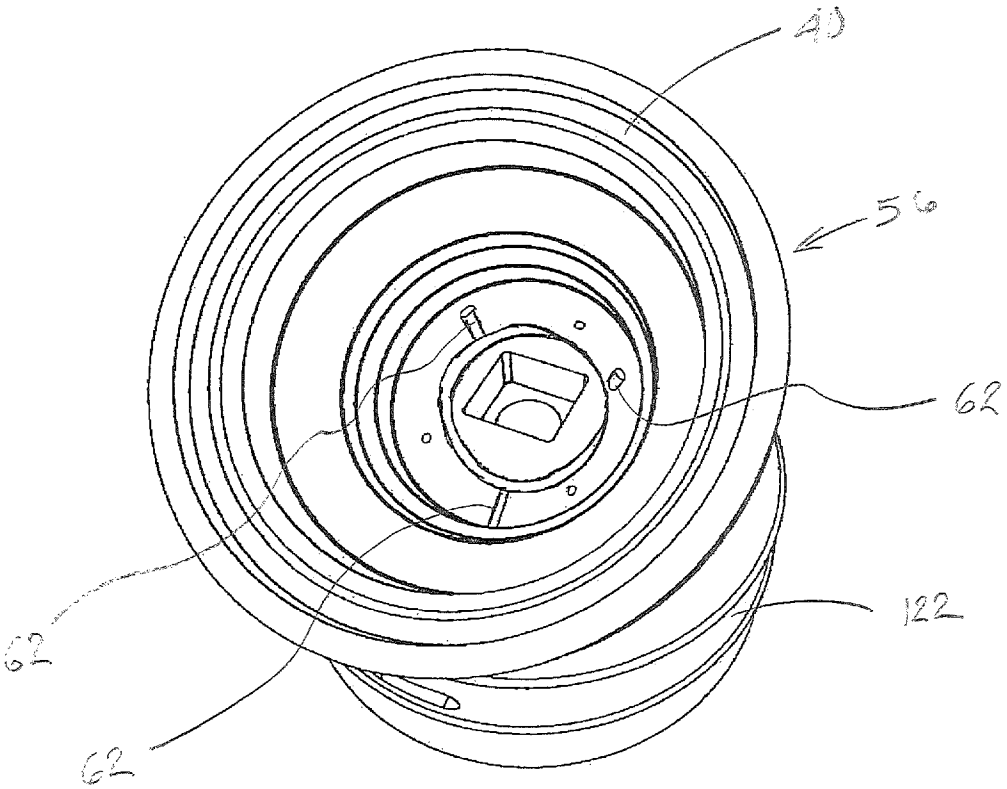
FIG. 4 is a view of the flashlight in FIGS. 1-3 with the connector bent as shown in FIG. 1.
Figure 5:
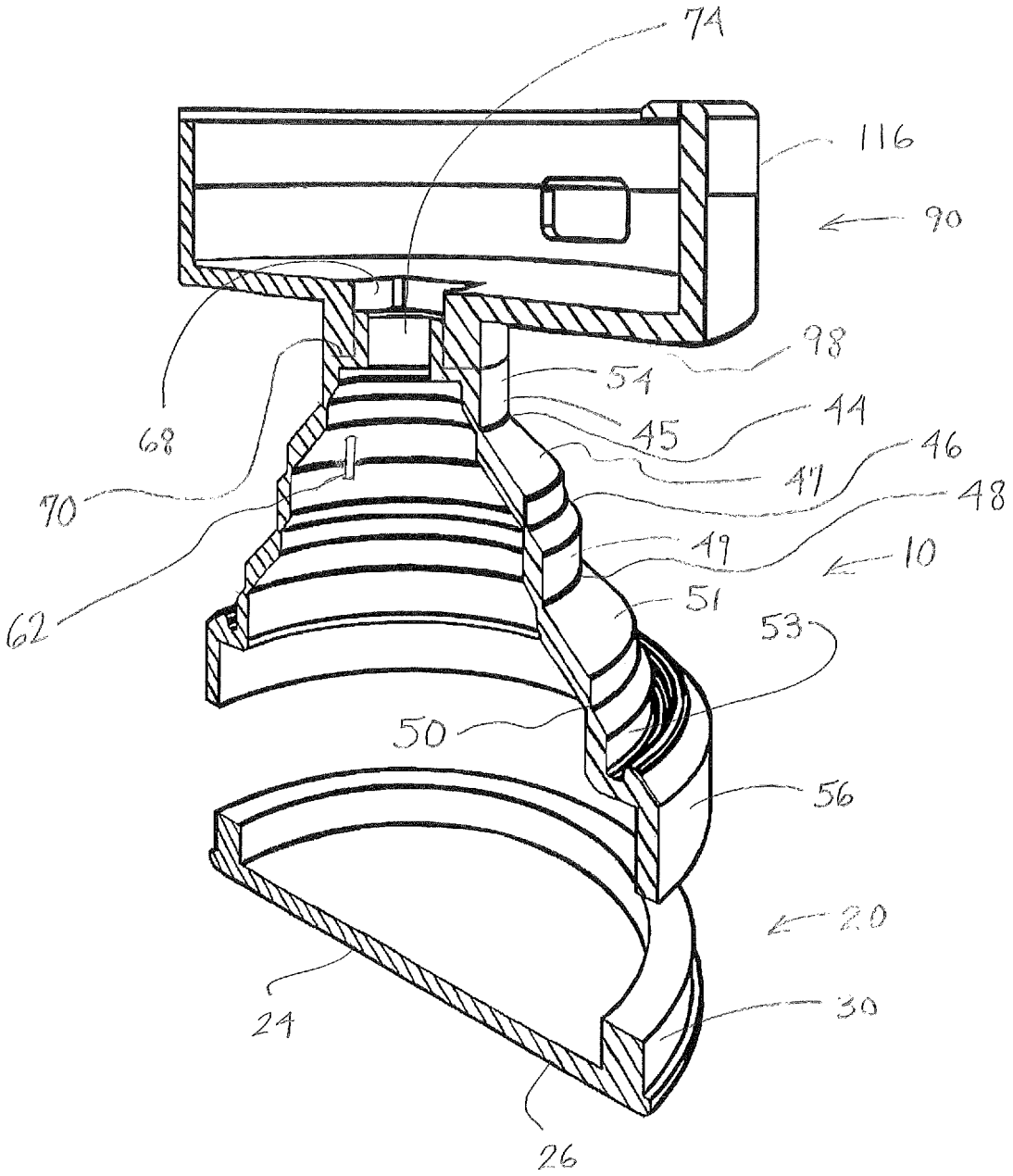
FIG. 5 is a sectional view of the flashlight shown in FIGS. 1-4.

On the inside of the connector 40 there are a set of three pegs 62 extending toward the base 20 as shown in FIG. 2. The pegs 62 are located on the second wall portion 47. The pegs 62 are located at equally spaced locations at approximately 120 degrees apart and extend toward the second end 56. Each peg 62 is round in its cross section and has an end surface 63 that is spaced from the second wall portion 47 from which they extend. The connector 40 at its first end 54 has a square boss 68 that extends upwardly above an upper shoulder 70. The square boss 68 has a hole 74 extending through the center. The connector 40 is movable between an extended position as shown in FIG. 5 to a retracted position. The extended position is characterized by the first end 54 and second end 56 being relatively farther apart than at the retracted position. The retracted position is characterized by the first end 54 and the second end 56 being very near each other. As the connector 40 moves from the extended position to the retracted position, the connector folds annularly at each of the scores 44, 46, 48, 50. The scores may be of varying thicknesses to determine the order in which the scores 44, 46, 48, 50 fold. As the connector 40 moves into its retracted position, the wall portions 45, 47, 49, 51, 53 concentrically nest adjacent to each other. Throughout all positions of movement, the connector 40 maintains a concentric relationship between the wall portions 45, 47, 49, 51, 53. During the motion from extended to retracted position, the wall portions 45, 47, 49, 51, 53 could potentially be misaligned so that they are not concentric with respect to each other and the pegs 62 assist with maintaining the concentric relationship between the wall portions 45, 47, 49, 51, 53 when the connector 40 is in its retracted position. When the connector 40 is in its extended position, the pegs 62 are aligned and substantially parallel with an axis 78 of the connector 40. As the connector 40 is moved from its extended position toward its retracted position, the pegs 62 are configured to rotate so that they bend nearly perpendicular to the axis 78 of the connector 40. As this occurs, the end surface 63 of each peg turns toward the third wall portion 49. Ultimately, when the connector 40 is in its retracted position, the end surfaces 63 of the pegs 62 contact the third wall portion 49. In the retracted position the second wall portion 47 and third wall portion 49 are adjacent and spaced apart equally around both walls because the pegs 63 are located equally spaced at approximately 120 degrees apart on the second wall portion 47, as shown in FIG. 3. The pegs 62 act as equally separated spacers that enforce a concentric relationship when the connector 40 is in its retracted position.

An upper section 90 includes a bottom portion 116 and a bezel 110. The bottom portion 116 is press fit to the bezel 94 and the bezel is adapted to capture a lens (not shown for clarity) between the bezel 94 and the bottom portion 116. The bottom portion 116 has a bottom wall 98 that includes a socket 100. The socket 100 receives the square boss 68. The square boss 68 fits into the socket 100 in a complementary manner. Both the socket 100 and square boss 68 could be different shapes that fit a complementary manner. The square boss 68 serves as an anti-rotation feature that prevents rotation of the upper section 90 with respect to the connector. The hole 74 is for receiving a fastener such as a screw that may be driven therethrough. Additionally, the hole 74 may be used for the passage of wires or other electrical connections between the upper section 90 and the base 20.

Figure 1:
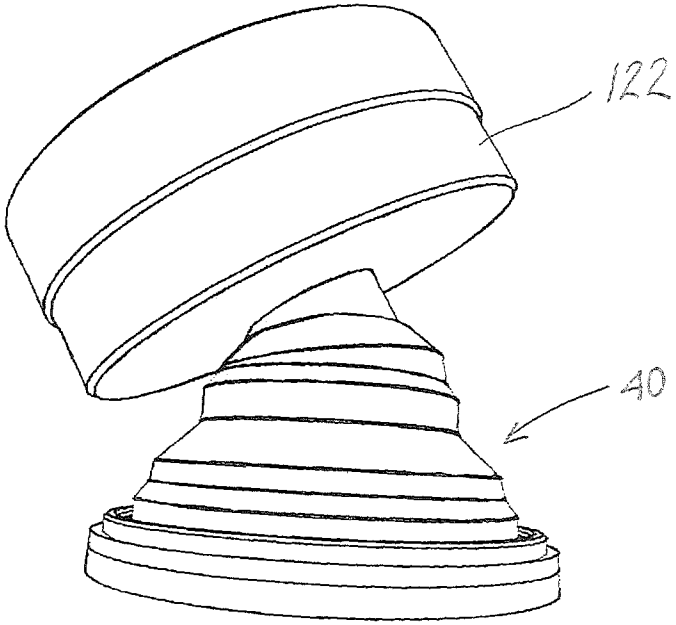
FIG. 1 is a side view of the flashlight bent at an angle.

During use, the upper section 90 may be moved with respect to the base 20. This movement may be between the extended position discussed above to a retracted position where the base 20 and upper section are in contact or near contact. In this retracted position, the connector 40 will maintain a concentric relationship between the base 20 and upper section 90. Additionally, it may be desirable to selectively bend the upper section 90 with respect to the base 20. FIG. 1 shows that angular movement is possible if the connector 40 is bent into an angle. The nature of the connector 40 allows it to hold an angled position if that is desired.

The bezel 110 as shown in FIG. 6 fits into the bottom portion 116 and the bezel 110 includes tabs 118 that extend toward the bottom portion 116. The tabs 118 mate with holes 120 in the bottom portion 116 near its upper end. The bezel 110 has an outer diameter 122 and an inner diameter 124 near its upper end and the holes 120 extend through the bottom portion 116 between the inner diameter 124 and the outer diameter 122 near the upper end of the bottom portion 116. The tabs 118 serve as an interlocking connection for the bezel 110 to the bottom portion 116. The interlocking connection between the bezel 110 and bottom portion 116 can also serve as a connection for other parts than just the bezel 110. Additionally, the tabs 118 may also serve as electrical contacts that provide an electrical connection through the bezel 110 and power to objects connected to the bezel 110. In addition to the tabs 118 holding the bezel 110 to the bottom portion 116, the bezel 110 may be held to the bottom portion 116 with magnets.

What is claimed is:

1. A flashlight comprising:

a base having a bottom end and a sidewall extending upwardly from said base;

a connector being made from a resilient material having a first end and a second end of said connector, said connector having a first wall defining said first end, a first score near said first end and a second score spaced from said first score, a second wall being located between said first and second score, a third score being spaced from said second score and a third wall being located between said second and third score, a fourth score being spaced from said third score and a fourth wall being located between said third and fourth score, and a fifth wall defining said second end of said connector, said connector being movable between an extended position and a retracted position, said second wall including pegs extending therefrom and said pegs extending equidistant from each other along said second wall and said pegs including an end surface spaced from said second wall, said pegs being movable from a first position wherein said end surfaces of said pegs is spaced from said third wall to a second position where said end surfaces of said pegs contact said third wall;

an upper section, said connector being affixed to said upper section and said base, said upper section being movable between an extended position and a retracted position, said extended position corresponding to said upper section being relatively far from said base and said retracted section corresponding to said upper section being relatively near to said base, movement between said extended position and said retracted position causing said walls of said connector to concentrically nest as said walls pivot about said scores separating said wall sections, movement from said extended to said retracted position moving said pegs from said first position to said second position, whereby said pegs extend between said second wall and said third wall to maintain a concentric relationship between said second and third wall when said connector is in its retracted position.

2. The flashlight of claim 1, wherein said connector includes a hole between said base and said upper section.

3. The flashlight of claim 2, wherein said upper section includes a bezel including tabs extending into the upper section, said tabs serving as electrical contacts into said upper section.

4. The flashlight of claim 3, wherein said bezel is held to said upper section with magnets.

* * * * *